US008579404B2

(12) United States Patent
Arimura

(10) Patent No.: US 8,579,404 B2
(45) Date of Patent: Nov. 12, 2013

(54) FLUID EJECTING HEAD, A FLUID EJECTING APPARATUS

(75) Inventor: Toshio Arimura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 787 days.

(21) Appl. No.: 12/417,533

(22) Filed: Apr. 2, 2009

(65) Prior Publication Data

US 2009/0251505 A1 Oct. 8, 2009

(30) Foreign Application Priority Data

Apr. 3, 2008 (JP) ..... 2008-096819
Mar. 18, 2009 (JP) ..... 2009-065715

(51) Int. Cl.
*B41J 29/38* (2006.01)

(52) U.S. Cl.
USPC ..... 347/17

(58) Field of Classification Search
USPC ..... 347/29, 47, 60, 17
See application file for complete search history.

(56) References Cited

U.S. PATENT DOCUMENTS 5,485,182 A * 1/1996 Takayanagi et al. ..... 347/17
6,206,499 B1 3/2001 Iijima et al.
6,457,802 B2 * 10/2002 Jackson ..... 347/35
6,679,595 B2 1/2004 Yamada et al.

FOREIGN PATENT DOCUMENTS

EP 0383019 A2 * 8/1990
JP 48-012628 A 2/1973
JP 2000-190513 A 7/2000
JP 2002-273894 A 9/2002
JP 2003-266705 A 9/2003

* cited by examiner

*Primary Examiner* — Julian Huffman
(74) *Attorney, Agent, or Firm* — Kilpatrick Townsend & Stockton LLP

(57) ABSTRACT

A recording head 4 includes a nozzle plate 22 provided with nozzle openings 23 ejecting ink, a heater 30 heating the ink, and a head cover 40 provided in contact with the nozzle plate 22 and having a predetermined function of protecting the nozzle plate 22. The heater 30 heats the ink through the head cover 40 and the nozzle plate 22.

11 Claims, 8 Drawing Sheets

FLUID EJECTING HEAD, A FLUID EJECTING APPARATUS

BACKGROUND OF THE INVENTION

The entire disclosure of Japanese Patent Application No. 2008-096819, filed 4, 3, 2008 is incorporated by reference herein.

The entire disclosure of Japanese Patent Application No. 2009-065715, filed 3, 18, 2009 is incorporated by reference herein.

FIELD OF THE INVENTION

The present invention relates to a fluid ejecting head and a fluid ejecting apparatus capable of heating and ejecting a liquid.

INVENTION OF RELATED ART

In the past, there was known a fluid ejecting head including a heating unit for heating a fluid and decreasing the viscosity of the fluid in order to stably eject the fluid having the high viscosity.

As an apparatus including the fluid ejecting head, an ink jet recording apparatus which includes a heater performing heating through a heat transfer member on a fluid board and a recording head in which the heat transfer member is also extended to a nozzle plate (nozzle plate) is disclosed in JP-A-2003-266705.

In the fluid ejecting head, a process of periodically cleaning ink (fluid) or the like attached to the nozzle plate at the time of ejecting the ink by a wiping member or the like made of rubber is performed. However, when the wiping member performing the wiping process collides with the edge of the nozzle plate, the wiping member may deteriorate rapidly. Therefore, in some cases, it is necessary to physically protect the edge of the nozzle plate by covering the edge of the nozzle plate, for example. Moreover, when a recording sheet as a fluid ejecting target is charged with static electricity and the nozzle plate is affected by the static electricity in this case, a problem with electrostatic breakdown of an electronic component such as a driving IC provided inside the fluid ejecting head may occur. Therefore, it is necessary to protect the nozzle plate against electricity.

SUMMARY OF THE INVENTION

The invention is devised in view of the above-mentioned problems and an object of the invention is to provide a fluid ejecting head capable of protecting a nozzle plate and ejecting a fluid by effectively heating the fluid and a fluid ejecting apparatus including the fluid ejecting head. Another object of the invention is to provide the fluid ejecting head capable of protecting the nozzle plate against electricity and the fluid ejecting apparatus including the fluid ejecting head.

In order to solve the above-mentioned problems, the invention provides a fluid ejecting head including: a nozzle plate which is provided with a nozzle opening ejecting a fluid; a heating unit which heats the fluid; and a protective member which is provided in contact with the nozzle plate and has a function of protecting the nozzle plate, wherein the heating unit heats the fluid through the protective member and the nozzle plate.

With such a configuration according to the invention, it is possible to heat the fluid in such a manner that the protective member coming in contact with the nozzle plate to protect the nozzle plate is used as a heat transfer medium and the heat generated by the heating unit is transferred to the nozzle plate directly coming in contact with the fluid.

According to the invention, a plurality of the nozzle openings are provided and the fluid ejecting head further comprises a fluid storage chamber which is connected to a plurality of fluid passages each formed in each of the nozzle openings. In addition, the nozzle plate forms a wall surface of a part of the fluid storage chamber.

With such a configuration according to the invention, the fluid stored in the fluid storage chamber can be all heated through the nozzle plate before the fluid is diverged into the nozzle openings. Accordingly, non-uniformity of the temperature rarely occurs after the fluid is diverged into the fluid passages from the fluid storage chamber and thus the viscosity of the fluid can be uniformly adjusted, thereby improving fluid ejection characteristics.

According to the invention, the fluid ejecting head may further include a heat insulating member which covers the protective member.

With such a configuration according to the invention, a heat loss can be reduced by allowing the heat insulating member to keep the temperature of the protective member. Accordingly, heating efficiency can be achieved.

According to the invention, the protective member may electrically ground the nozzle plate.

With such a configuration according to the invention, the potential of the nozzle plate can be set to the ground potential. Therefore, a problem with electrostatic breakdown of an electronic component such as a driving IC can be solved.

According to the invention, the nozzle plate may be provided with a plurality of nozzle rows in which the plurality of nozzle openings are arranged, and the protective member covers a nozzle surface on which the nozzle rows are formed and has openings arranged along the nozzle rows.

With such a configuration according to the invention, the nozzle surface area to be covered can be increased. Therefore, the nozzle plate can be further protected against an impact or the like and the heat of the heating unit can be uniformly transferred to the entire surface of the nozzle plate.

According to the invention, the fluid ejecting head may further include a temperature detector which detects the temperature of the fluid and a controller which controls drive of the heating unit on the basis of a result detected by the temperature detector.

With such a configuration according to the invention, the temperature of the fluid can be set to a desired temperature. Therefore, the fluid having a desired viscosity can be ejected by adjusting the viscosity of the fluid with good precision.

According to the invention, the temperature detector may detect the temperature of the fluid on the basis of a temperature of the protective member.

With such a configuration according to the invention, the temperature of the fluid can be detected from the outside without direct contact with the fluid.

According to the invention, a heat generating section of the heating unit may be interposed between a case member supporting the nozzle plate and the protective member. The fluid ejecting head may further include a sealing member which seals the heat generating section by allowing a space between the case member and the protective member to be liquid-tight.

With such a configuration according to the invention, the heat generating section can be sealed in the liquid-tight manner. Therefore, when the nozzle plate is wiped by the wiping member, it is possible to prevent the temperature from increasing since the fluid sinks from the contact portion between the nozzle plate and the protective member due to a capillary phenomenon and the fluid reaches the heat generating section interposed between the case member and the protective member.

According to the invention, the heat generating section of the heating unit may be interposed between a case member supporting the nozzle plate and the protective member, and the fluid ejecting head may further include a locking member which comes in contact with the protective member to lock opening of the protective member in a direction that is away from the case member.

With such a configuration according to the invention, the expansion of the protective member can be restrained. Therefore, the protective member and the heat generating section can closely come in contact with each other and it is easy to make an assembly since the protective member is positioned.

According to the invention, the locking member may be provided in a heat insulating member that covers the protective member.

With such a configuration according to the invention, the temperature of the protective member can be kept just by one member and the expansion of the protective member can be restrained. Accordingly, an increase in the number of components can be suppressed.

The invention provides a fluid ejecting apparatus ejecting a fluid onto a predetermined target from a fluid ejecting head and including the above-described fluid ejecting head as the fluid ejecting head.

With such a configuration according to the invention, it is possible to obtain the fluid ejecting apparatus including the fluid ejecting head capable of protecting the nozzle plate and efficiently heating the fluid to eject the fluid.

DESCRIPTION OF PREFERRED EMBODIMENT

Figure 1:
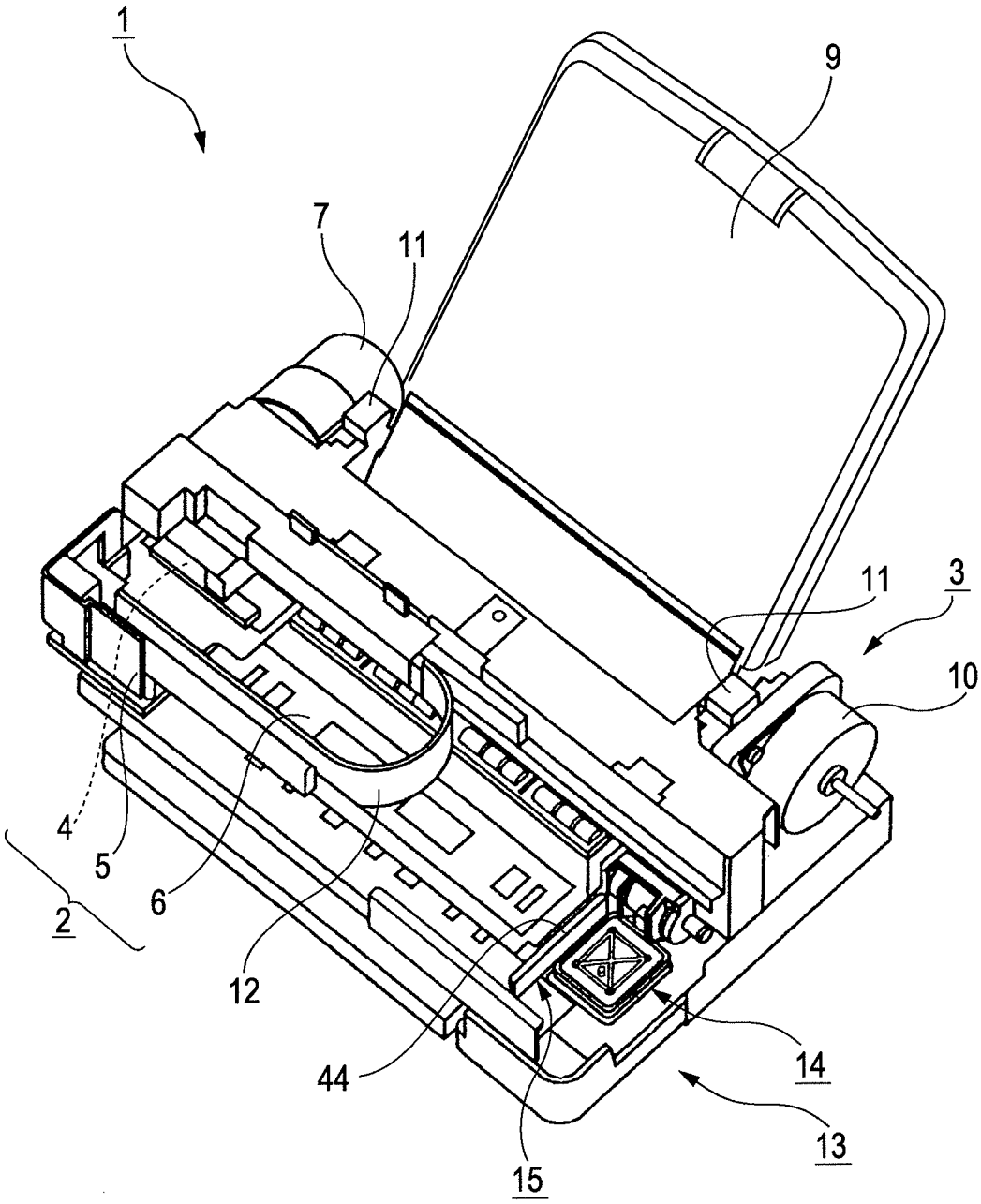
FIG. 1 is a perspective view illustrating an example of a fluid ejecting apparatus according to an embodiment of the invention.

Hereinafter, a fluid ejecting head and a fluid ejecting apparatus according to the invention will be described with reference to the drawings. In the drawings used in the following description, scales of constituent elements are appropriately changed to allow the constituent elements to be recognizable.

First Embodiment

FIG. 1 is a perspective view illustrating an example of a fluid ejecting apparatus according to an embodiment.

The fluid ejecting apparatus according to this embodiment is a fluid ejecting apparatus ejecting a fluid such as ink. As an example of the fluid ejecting apparatus, an ink jet recording apparatus which ejects ink onto a recording medium from ejection openings of a recording head to perform recording on the recording medium will be described.

In the following description, as an example of the ink jet recording apparatus, an ink jet printer discharging (ejecting) ink droplets onto a recording sheet (a target) as the recording medium to perform recording on the recording sheet will be described.

As shown in FIG. 1, an ink jet printer 1 includes a recording unit 2 which performs recording on the recording sheet by ejecting ink and a recording sheet transport mechanism 3 which transports the recording sheet.

The recording unit 2 includes a recording head (a fluid ejecting head) 4 which ejects ink, a carriage 5 which is moved while supporting the recording head 4, and a platen 6 which is disposed at a position opposed to the recording head 4 and the carriage 5 and supports the recording sheet on which the ink is ejected.

The ink jet printer 1 includes a carriage driving device 7 which has a motor moving the carriage 5 and a carriage guide member which guides the movement of the carriage 5.

The carriage 5 is moved in a main scanning direction by the carriage driving device 7 while being guided by the carriage guide member. The recording sheet is moved in a sub-scanning direction intersecting the main scanning direction with respect to the recording unit 2 by the recording sheet transporting mechanism 3.

The ink jet printer 1 includes a feeding cassette 9 accommodating the recording sheets.

The feeding cassette 9 is detachably mounted on a side of the rear surface of a main body of the ink jet printer 1. The feeding cassette 9 is provided to accommodate the plurality of recording sheets stacked.

The recording sheet transporting mechanism 3 includes a feeding roller which feeds the recording sheet accommodated in the feeding cassette 9, a feeding roller driving device 10 which has a motor driving the feeding roller, a recording sheet guide member 11 which guides the movement of the recording sheet, a transport roller which is disposed on a downstream side of the feeding roller in a transport direction, a transport roller driving device which drives the transport roller, and a discharge roller which is disposed on a downstream side of the recording unit 2 in a transport direction.

The feeding roller is configured to pick up the uppermost recording sheet among the plurality of recording sheets stacked in the feeding cassette 9 and takes it out from the feeding cassette 9. The recording sheet of the feeding cassette 9 is sent to the transport roller by the feeding roller driven by the feeding roller driving device 10, while being guided by the recording sheet guide member 11. The recording sheet sent to the transport roller is transported to the recording unit 2 disposed on the downstream side in the transport direction by the transport roller which is driven by the transport roller driving device.

The platen 6 of the recording unit 2 is disposed at a position opposed to the recording head 4 and the carriage 5 and supports the lower surface of the recording sheet. The recording head 4 and the carriage 5 are disposed above the platen 6. The recording sheet transport mechanism 3 transports the recording sheet in the sub-scanning direction in interlock with a recording operation performed by the recording unit 2. The recording sheet on which an image is recorded by the recording unit 2 is discharged from the front surface of the ink jet printer 1 by the recording sheet transport mechanism 3 including the discharge roller.

The ink jet printer 1 includes an ink supply tube 12 which supplies ink stored in an ink cartridge to the recording head 4 of the carriage 5. The ink stored in the ink cartridge is supplied to an ink supply passage through an ink supply needle, and then the ink is supplied from the ink supply passage to the recording head 4 of the carriage 5 via the ink supply tube 12.

The ink jet printer 1 includes a maintenance device 13 capable of maintaining the recording head 4.

The maintenance device 13 includes a capping unit 14 and a wiping unit 15. The wiping unit 15 includes a wiping member 44 opposed to the recording head 4. The wiping unit 15 wipes or removes foreign substances such as residual ink attached to an ejection surface (a nozzle surface) 17 (which is described below) of the recording head 4 by use of the wiping member 44.

The maintenance device 13 is disposed at a home position of the carriage 5 and the recording head 4. The home position is within a movement area of the carriage 5 and is located in an end area outside a recording area where a recording operation is performed by the recording unit 2.

When the power is not supplied or the recording operation is not performed for a long time, the carriage 5 and the recording head 4 are located at the home position. In addition, a thermometer is connected to the recording head 4 to measure the temperature of the recording head 4.

Next, the configuration of the recording head 4 according to this embodiment will be described with reference to FIGS. 2 and 4.

Figure 2:
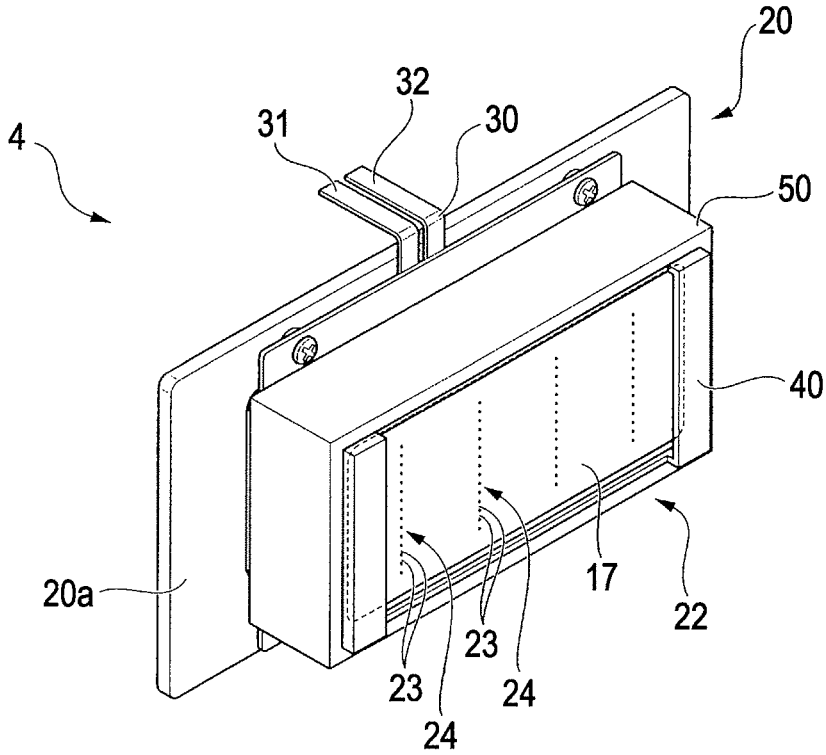
FIG. 2 is a perspective view illustrating a recording head according to the embodiment of the invention.
Figure 3:
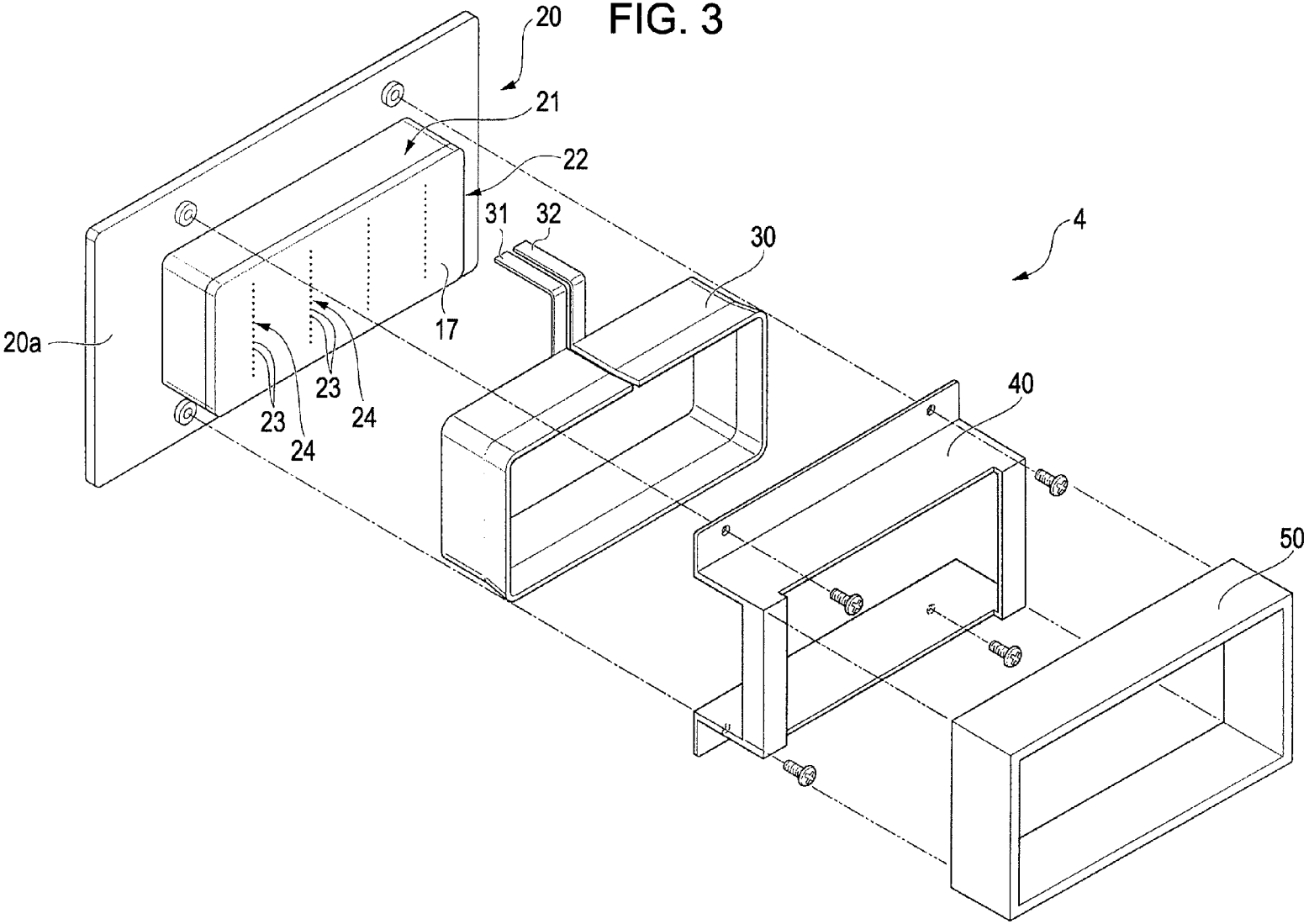
FIG. 3 is an exploded view illustrating the recording head according to the embodiment of the invention.

FIG. 2 is a perspective view illustrating the recording head 4 according to this embodiment. FIG. 3 is an exploded view illustrating the recording head 4. FIG. 4 is a sectional view illustrating the recording head 4.

As shown in FIG. 3, the recording head 4 is formed such that a head main body 20, a heater (heating unit) 30, a head cover (a protective member) 40, and a heat insulating plate (a heat insulating member) 50 overlap with each other in this order.

The head main body 20 includes a case member 21 and a nozzle plate 22. The nozzle plate 22 has the ejection surface 17 on which a plurality of nozzle openings 23 ejecting ink are arranged at a predetermined pitch to form a plurality of nozzle rows 24. The nozzle plate 22 according to this embodiment is a plate-shaped member made of metal such as stainless steel and having a heat transfer property. The case member 21 is a box-like member made of a synthetic resin, for example, and having a desired ink storage space therein.

Figure 4:
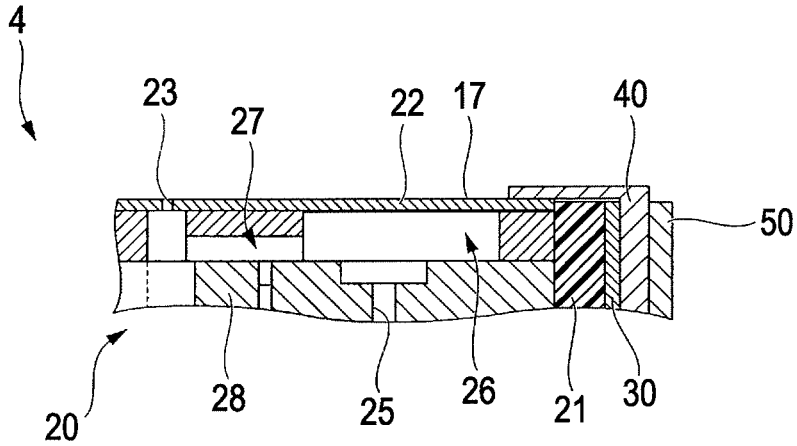
FIG. 4 is a sectional view illustrating the recording head according to the embodiment of the invention.

As shown in FIG. 4, the head main body 20 includes an ink introducing port 25 which communicates with the ink supply passage, a common ink chamber (a fluid storage chamber) 26 which stores ink supplied from the ink introducing port 25, separate ink chambers (fluid passages) 27 which are individually diverged from the common ink chamber 26 into the nozzle openings 23, and piezoelectric elements 28 which are individually provided in the separate ink chambers 27.

The common ink chamber 26 storing all the ink before the ink is diverged into the nozzle openings 23 through the separate ink chambers 27 is configured so as to form the desired ink storage space by joining the nozzle plate 22 to a concave portion formed in the case member 21 to cover the concave portion. That is, one surface (a part) of the common ink chamber 26 according to this embodiment is configured as the nozzle plate 22 having a heat transfer property.

The separate ink chambers 27 are individually provided in correspondence with the nozzle openings 23. The separate ink chambers 27 are connected to the common ink chamber 26 so as to be supplied with ink from the common ink chamber 26. The nozzle plate 22 has a configuration of transferring heat to the separate ink chambers 27 through a cavity board forming the separate ink chambers 27.

The piezoelectric element 28 has a configuration in which the ink is ejected from the nozzle opening 23 by varying the inner volume of the separate ink chamber 27 by drive of an electric signal having a predetermined driving frequency and by controlling the liquid pressure of the ink filled in the separate ink chamber 27.

In this embodiment, as shown in FIGS. 2 and 3, the head cover 40 molded from a metal plate such as a stainless steel plate having a heat transfer property and a conductive property, like the nozzle plate 22, has a configuration in which the edge of the ejection surface 17 of the nozzle plate 22 is covered and the nozzle openings 23 are exposed. As shown in FIG. 4, the head cover 40 is mounted so that a part thereof contacts with the edges of the nozzle plate 22.

The head cover 40 is mounted on a flange 20*a* of the head main body 20 by a plurality of screw members to be electrically connected to a ground line (not shown) electrically connected to the main body of the ink jet printer 1 through the flange 20*a*. With such a configuration, the head cover 40 is configured so as to be adjusted with the grounding potential.

As shown in FIG. 3, the heater 30 is molded along the side surfaces of the head main body 20 and interposed between the head main body 20 and the head cover 40 in a contact manner. In this embodiment, the heater 30 formed of a member having an electro-thermal property, for example, has a configuration in which end portions 31 and 32 are electrically connected to the main body of the ink jet printer 1 and fed with electricity so as to generate heat.

The heater 30 has the configuration in which a desired amount of generated heat or a heat generated area without restriction on an installation space is guaranteed by installing the heater outside the head main body 20 and heating the ink of the head main body 20 through the head cover 40 and the nozzle plate 22, compared to a case where the heater is installed inside the head main body 20.

Since the heat insulating plate 50 has a rectangular frame shape molded so as to cover the side surfaces of the head cover 40, a thermal conductivity thereof is low. With such a configuration, a heat keeping effect is increased by restraining heat dissipation from the head cover 40 to the ambient air. The heat insulating plate 50 is inserted into the head cover 40.

Next, an operation of heating and ejecting the ink of the recording head 4 having the above-described configuration will be described.

First, the heater 30 generates heat of a desired temperature for adjusting the viscosity of the ink, since the end portions 31 and 32 are electrically connected. For example, when the ink having a high viscosity is UV ink, it is preferable that the heater generates heat in the range from 40° C. to 50° C. As shown in FIG. 4, the heat generated by the heater 30 is transferred to the head cover 40 contacting with the heater 30.

The head cover 40 transfers the heat generated by the heater 30 to the nozzle plate 22 contacting with the head cover. Here, the heat insulating plate 50 blocks the heat from the head cover 40 to the ambient air to keep the temperature of the head cover 40.

The head cover 40 protects the edge of the nozzle plate 22 against an impact with the wiping member 44 of the wiping unit 15 shown in FIG. 1 and adjusts the potential of the nozzle plate 22 by contacting with the ejection surface 17 of the nozzle plate 22 and electrically connecting the nozzle plate 22 to the ground line of the main body of the ink jet printer 1.

Accordingly, it is possible to prevent a problem with an electrostatic breakdown, which causes the breakdown of a driving circuit or the like through the nozzle plate 22 due to static electricity generated by the recording sheet, or an erroneous operation, which is superimposed in an electric signal of the piezoelectric elements 28.

The nozzle plate 22 transfers the heat transferred from the head cover 40 to the ink stored in the head main body 20 including the nozzle openings 23, the common ink chamber 26, and the separate ink chambers 27. Here, since the nozzle plate 22 forms one surface of the common ink chamber 26, the nozzle plate can directly transfer the heat of the heater 30 to the ink stored in the common ink chamber 26. Moreover, since the area of the common ink chamber 26 to which the heat is transferred is larger than the area of the separate ink chambers 27 to which the heat is transferred, all the ink can be heated. Accordingly, even when a flow speed of the ink circulating in the separate ink chambers 27 is changed, for example, when the driving frequency of the piezoelectric elements 28 is changed or when the ink is selectively ejected from the plurality of nozzle openings 23, non-uniformity of the temperature of the ink of the respective separate ink chambers 27 rarely occurs by uniformly heating the ink before the divergence, thereby stably ejecting the ink.

The ink heated at a uniform temperature in the common ink chamber 26 so as to uniformly adjust the viscosity of the ink is supplied to the separate ink chambers 27, ejected from the nozzle openings 23 by drive of the piezoelectric elements 28 individually provided in the separate ink chambers 27, and then attached onto the recording sheet.

According to the above-described embodiment, the recording head 4 includes the nozzle plate 22 provided with the nozzle openings 23 ejecting ink, the heater 30 heating the ink, and the head cover 40 provided in contact with the nozzle plate 22 and having a predetermined function of protecting the nozzle plate 22. The heater 30 heats the ink through the head cover 40 and the nozzle plate 22. With such a configuration, it is possible to effectively heat the ink by utilizing the head cover 40 contacting with the nozzle plate 22 and protecting the nozzle plate against an external factor as a heat transfer medium and by transferring the heat generated by the heater 30 to the nozzle plate 22 directly contacting with the ink.

According to this embodiment, it is possible to provide the recording head 4 capable of protecting the nozzle plate 22 and effectively heating the ink to eject the ink and the ink jet printer 1 including the recording head.

According to this embodiment, the plurality of nozzle openings 23 are provided and the common ink chamber 26 connected to the separate ink chambers 27 individually formed in the nozzle openings 23 is included. The nozzle plate 22 forms one surface of the common ink chamber 26. With such a configuration, it is easy to heat all the ink through the nozzle plate 22 before the ink is diverged into the nozzle openings 23. Accordingly, since the non-uniformity of the temperature after the ink is diverged from the common ink chamber 26 into the separate ink chambers 27 rarely occurs, it is possible to uniformly adjust the viscosity of the ink and improve ink ejection characteristics.

According to this embodiment, the heat insulating plate 50 covering the head cover 40 is included. With such a configuration, since a heat loss from the head cover 40 can be reduced, heating efficiency can be achieved.

According to this embodiment, the head cover 40 electrically grounds the nozzle plate 22. With such a configuration, the problem with electrostatic breakdown of an electronic component such as a driving IC can be solved, since the potential of the nozzle plate can be set to the ground potential along with the heat transfer function.

According to this embodiment, the ink jet printer 1 including the recording head 4 is provided. With such a configuration, it is possible to realize the ink jet printer 1 capable of protecting the nozzle plate 22 and effectively heating the ink to eject the ink.

Second Embodiment

Next, a second embodiment of the invention will be described with reference to FIGS. 5 to 8. In the following description, the same reference numerals are given to the same constituent elements as those of the first embodiment and the description is omitted.

Figure 5:
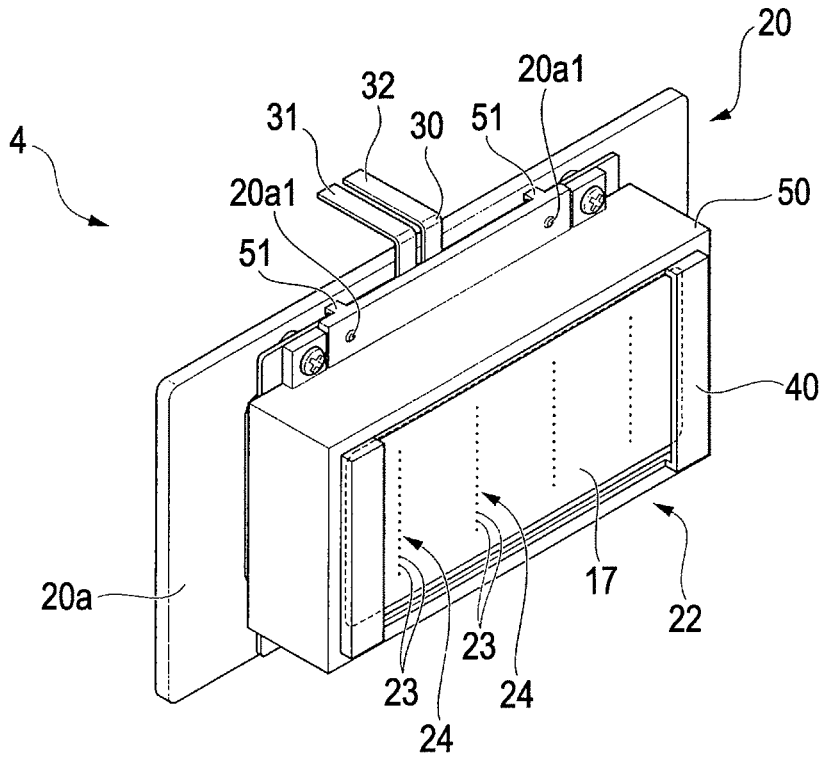
FIG. 5 is a perspective view illustrating a recording head according to a second embodiment of the invention.
Figure 6:
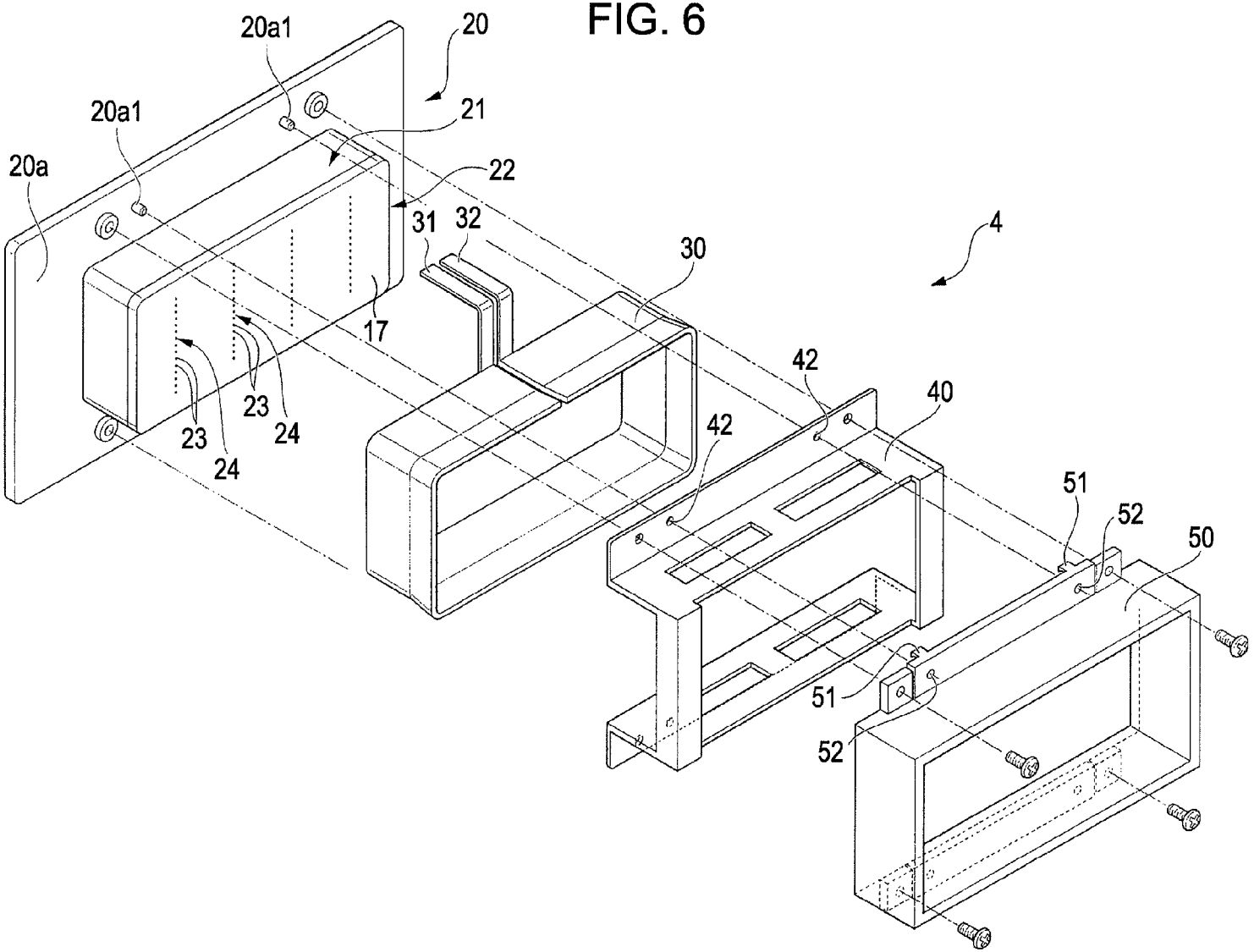
FIG. 6 is an exploded diagram illustrating the recording head according to the second embodiment of the invention.
Figure 7:
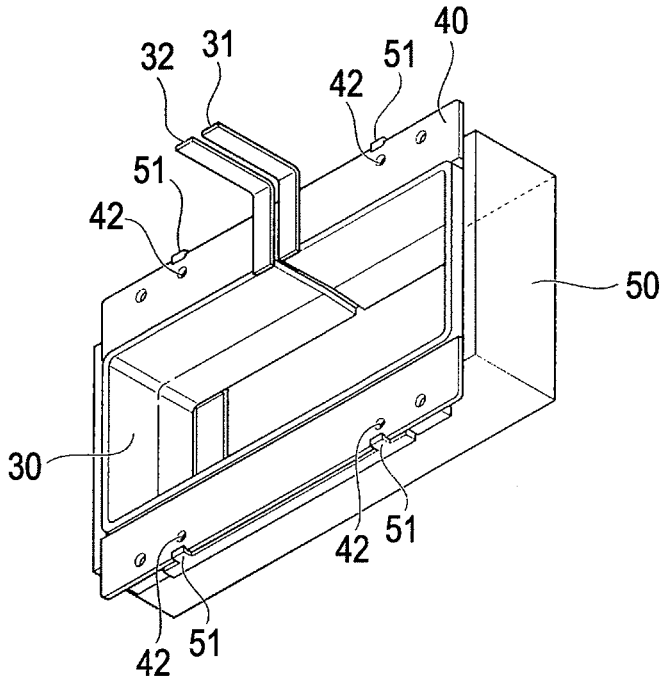
FIG. 7 is a perspective view illustrating an assembly of a heater, a head cover, and a heat insulating plate according to the second embodiment.
Figure 8:
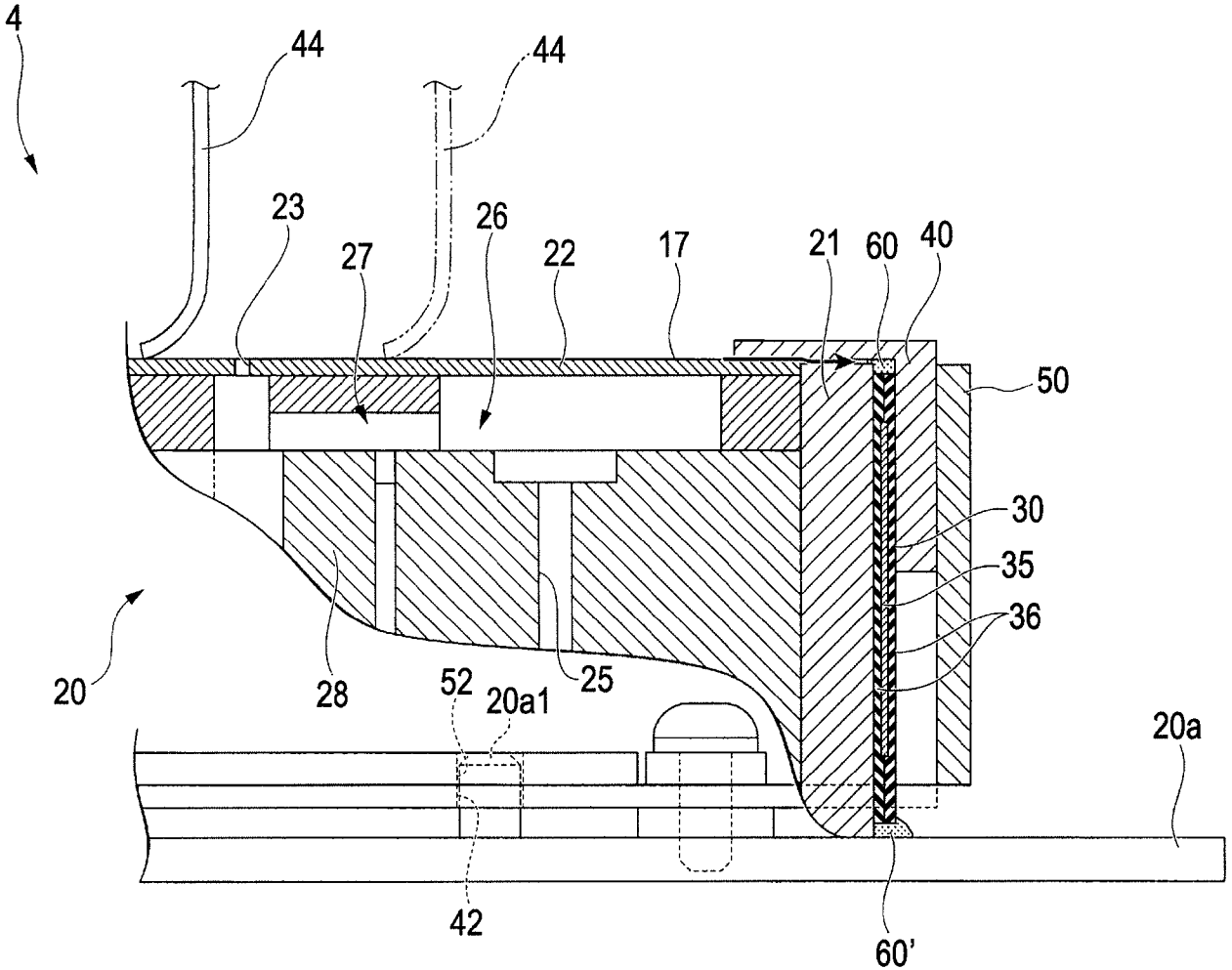
FIG. 8 is a partial sectional view illustrating the recording head according to the second embodiment of the invention.

FIG. 5 is a perspective view illustrating the recording head 4 according to the second embodiment. FIG. 6 is an exploded view illustrating the recording head 4. FIG. 7 is a perspective view illustrating an assembly of the heater 30, the head cover 40, and the heat insulating plate 50. FIG. 8 is a partial sectional view illustrating the recording head 4 in a direction perpendicular to the nozzle row 24.

Main differences between the first and second embodiments are that (1) the heater (a heat generating section) 30 interposed between the case member 21 and the head cover 40 is sealed in a liquid-tight manner by a sealing member 60 (see FIG. 8) and (2) locking claws (a locking member) 51 which lock the opening of the head cover 40 in a direction getting away from the case member 21 are provided (see FIGS. 5 to 7).

As shown in FIG. 8, the heater 30 includes an electro-thermal layer 35 fed with electricity to generate heat and a pair of insulating layers 36 interposing the electro-thermal layer 35. The electro-thermal layer 35 according to this embodiment is made of stainless steel (SUS), for example, and the insulating layers 36 are made of a resin material such as polyimide. The heater 30 is interposed between the case member 21 supporting the nozzle plate 22 and the head cover 40.

First, a configuration and an operation of the difference (1) will be described.

In the first embodiment, when the nozzle plate 22 is wiped by the wiping member 44, the ink may sink from a contact portion between the nozzle plate 22 and the head cover 40 due to a capillary phenomenon and the ink may reach the heater 30 interposed between the case member 21 and the head cover 40, thereby obstructing an increase in a temperature. Specifically, a problem may occur in that a short circuit is caused due to intrusion of the ink into the heater 30 from the bonded end surface of the insulating layers 36. Alternatively, a problem may occur in that in the configuration in which a temperature sensor is provided between the heater 30 and the case member 21, it is difficult to control the temperature due to a variation (deviation) in the measured temperature caused by a phenomenon of partly increasing the temperature since the ink intrudes into a space between the heater 30 and the case member 21 and thus the heater 30 floats.

In the second embodiment, in order to solve the problems, there is provided the sealing member 60 sealing the heater 30 by allowing a space between the case member 21 and the head cover 40 to be liquid-tight. As shown in FIG. 8, the sealing member 60 is provided at a position which is located between the case member 21 and the head cover 40 and corresponds to the bonded end surface of the insulating layers 36. The sealing member 60 according to this embodiment is formed by molding a silicon adhesive having a liquid-resistant property at the position. Alternatively, a member such as a rubber packing having elasticity and capability to seal the heater in a liquid-tight manner may be used as the sealing member 60.

With such a configuration, when the nozzle plate 22 is wiped by the wiping member 44, the ink sinking from the contact portion between the nozzle plate 22 and the head cover 40 due to the capillary phenomenon cannot intrude up to the heater 30 (in an upstream side). That is because the sealing member 60 seals the heater 30 in the liquid-tight manner (see an arrow shown in FIG. 8). Accordingly, the temperature of the ink can be smoothly increased without obstruction of heating by the heater 30. In addition, even though not serious in comparison to the above case, ink intruding along the outer surface of the head cover 40 can be blocked by similarly providing a sealing member 60' in a space between the head cover 40 and the heat insulating plate 50 before the ink reaches the heater 30.

Next, a configuration and an operation of the difference (2) will be described.

As described above, the head cover 40 has a spring property, since the head cover is made of a metallic material such as stainless steel. Therefore, the head cover can resist deformation to some extent. However, when the heater 30 is assembled so as to be interposed between the case member 21 and the head cover 40, a problem may occur in that the head cover 40 is expanded in a direction getting away from the case member 21 by the heater 30. In consequence, the heater 30 is not tightly interposed between the case member 21 and the head cover 40 and thus the heat transfer property may deteriorate. In the second embodiment, as shown in FIG. 6, pins **20*a*1 as positioning means for positioning the head cover 40 to the nozzle plate 22 are provided in the flange 20*a* and pin insertion holes 42 into which the pins 20*a*1 are inserted are provided in the head cover 40. However, a problem may occur in that the pins 20*a*1 cannot be smoothly inserted into the pin insertion holes 42**.

In the second embodiment, in order to solve this problem, the heat insulating plate 50 is provided with locking claws 51 which comes in contact with the head cover 40 to lock opening of the head cover in a direction getting away from the case member 21. The pair of locking claws 51 are provided at positions which deviate from the end portions 31 and 32 of the heater 30 and into which the case member 21 and the head cover 40 are inserted in a direction of a shorter side. The locking claws 51 restrain the expansion of the head cover 40 by locking the end of the head cover 40 coming in contact with the flange **20*a***.

With such a configuration, since the expansion of the head cover 40 can be restrained, the head cover 40 and the heater 30 can tightly contact with each other, thereby achieving the heat transfer efficiency. As shown in FIG. 7, since the heat insulating plate 50 and the head cover 40 are mounted on the head main body 20 at a state the heat insulating plate and the head cover are positioned to each other through the locking claws 51, the pins **20*a*1 can be smoothly inserted into the pin insertion holes 42 to easily make an assembly. In this embodiment, since the pin insertion holes 52 into which the pin 20*a*1 are inserted are also formed in the heat insulating plate 50, the heat insulating plate 50** is also positioned.

In this embodiment, the locking claws 51 are incorporated to the heat insulating plate 50. With such a configuration, the temperature of the head cover 40 can be kept by just one member and the expansion of the head cover 40 can be restrained. Accordingly, it is possible to suppress an increase in the number of components. Moreover, it is preferable that the heat insulating plate 50 is made of a material having a harder property than that of the head cover 40 from viewpoint of restraining the expansion of the head cover 40.

The preferred embodiments of the invention have been described with reference to the drawings, but the invention is not limited to the above-described embodiments. All the shapes or combinations of the constituent elements in the above-described embodiments are just examples and may be modified in various forms without departing the gist of the invention on the basis of the design requirement or the like.

Figure 9:
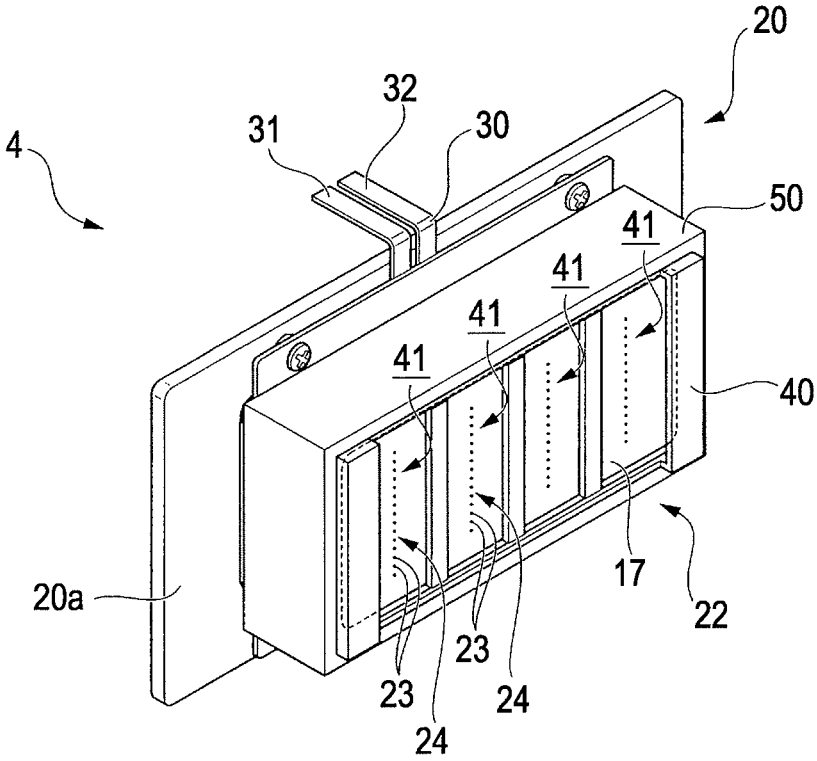
FIG. 9 is a perspective view illustrating a recording head according to a different embodiment of the invention.

For example, in the above-described embodiments, the head cover 40 has the configuration in which the edge of the ejection surface 17 of the nozzle plate 22 is covered. However, the invention may realize a head cover 40 according to a different embodiment, as shown in FIG. 9. The head cover 40 according to the different embodiment covers an ejection surface 17 on which nozzle rows 24 are formed and includes openings 41 formed along the respective nozzle rows 24.

With such a configuration, the head cover 40 according to the different embodiment is configured so as to cover a larger area of the ejection surface 17 of the nozzle plate 22, compared to the above embodiments. According to the different embodiment, the nozzle plate 22 can be further protected against from the impact and can uniformly transfer the heat of the heater 30 to the entire surface of the nozzle plate 22. Accordingly, it is possible to obtain an advantage of stably ejecting the ink having a high viscosity from the recording head 4.

For example, in order to eject ink having a desired viscosity by adjusting the temperature of the ink with good precision, a temperature detector detecting the temperature of the ink and a controller controlling the drive of the heater 30 on the basis of a result detected by the temperature detector may be provided. In this case, it is preferable that the temperature detector is disposed inside the common ink chamber 26 of the head main body 20 or an ink storage space of the separate ink chamber 27.

Alternatively, when a space for disposing the temperature detector inside the head main body 20 is restricted, the temperature of the ink may be detected on the basis of the temperature of the head cover 40 transferring the heat of the heater 30. In this case, means may be used for detecting the temperature of the ink by measuring correspondent values between the temperature of the head cover 40 and the temperature of the ink by an experiment, storing the measurement result as table data in advance, and comparing the detection result of the temperature of the head cover 40 detected by the temperature detector to the table data.

A thermometer has been used as the temperature detector, but a temperature detecting element such as a thermoelectric couple or a thermistor may be used.

In the above-embodiments, for example, the heater 30 has been described as the member having the electro-thermal property, but the invention is not limited to the above-described configuration. For example, the heater 30 may have a configuration in which a heat medium such as water or air is circulated to heat the ink.

For example, the invention is not limited to the method of heating the ink only by the heater 30. For example, the ink may be heated in cooperation with a second heating unit which heats the ink on a more upstream side than the common ink chamber 26.

In the above-described embodiments, the fluid ejecting apparatus has been described as an example of the ink jet printer 1, but the invention is not limited to the ink jet printer. An apparatus such as a copy machine or facsimile machine may be used.

In the above-described embodiments, the fluid ejecting apparatus ejecting a fluid (a liquid-like material) such as ink has been exemplified, but the fluid ejecting apparatus according to the invention is applicable to a fluid ejecting apparatus discharging or ejecting a fluid other than ink. A fluid ejected by the fluid ejecting apparatus includes a fluid, a liquid-like material in which particles of a functional material are dispersed or dissolved, a colloidal material such as gel, a solid ejected by flowing as a fluid, and a fine particle (toner, etc.).

In the above-described embodiments, as the fluid (a liquid-like material) ejected by the fluid ejecting apparatus, a fluid suitable for a specific use as well as ink can be applied. A predetermined device can be manufactured by providing an ejecting head capable of ejecting a fluid suitable for the specific use in the fluid ejecting apparatus and ejecting the fluid suitable for the specific use so that the fluid is attached to a predetermined object. For example, the fluid ejecting apparatus (a liquid-like material ejecting apparatus) according to the invention is applicable to a fluid ejecting apparatus capable of ejecting a fluid (a liquid-like material) in which a material such as an electrode material or a coloring material used to manufacture a liquid crystal display, an EL (Electroluminescence) display, and a field emission display (FED) is dispersed (dissolved) in a predetermined disperse medium (solvent).

The fluid ejecting apparatus may be an apparatus capable of ejecting a bio organic matter used to manufacture a bio chip or a fluid ejecting apparatus used as a precise pipette capable of ejecting a fluid as a sample.

Moreover, the liquid ejecting apparatus may be a fluid ejecting apparatus ejecting lubricant to a precise machine such as a clock or a camera by use of a pin point, a fluid ejecting apparatus ejecting a transparent resin liquid such as a ultraviolet-curable resin onto a substrate to form a micro semi-circular lens (optical lens) used in an optical communication device, a fluid ejecting apparatus ejecting etchant such as acid or alkali to etch a substrate and the like, a colloidal material ejecting apparatus ejecting gel, or a toner jet recording apparatus ejecting a solid as a fine particle such as toner. In addition, the invention is applicable to one of the above apparatuses.

What is claimed is:

1. A fluid ejecting head comprising:

a fluid storage chamber for storing a fluid therein;

a nozzle plate which is provided with a nozzle opening configured for ejecting the fluid stored within the fluid storage chamber;

a heating unit configured for heating the fluid disposed within the chamber; and a protective member which is provided in contact with the nozzle plate and configured to protect the nozzle plate, wherein the heating unit is configured such that the fluid disposed within the fluid storage chamber is heated with a heated portion of the nozzle plate that is heated by thermal conduction with heat from the heating unit conducted through the protective member and the nozzle plate and to the heated portion of the nozzle plate.

2. The fluid ejecting head according to claim 1, wherein a plurality of the nozzle openings are provided and the fluid ejecting head further comprises a fluid storage chamber which is connected to a plurality of fluid passages each formed in each of the nozzle openings, and wherein the nozzle plate forms a wall surface of a part of the fluid storage chamber.

3. The fluid ejecting head according to claim 1, further comprising a heat insulating member which covers the protective member and restrains heat dissipation to the ambient air.

4. The fluid ejecting head according to claim 1, wherein the protective member electrically grounds the nozzle plate.

5. The fluid ejecting head according to claim 1, wherein the nozzle plate is provided with a plurality of nozzle rows in which the plurality of nozzle openings are arranged, and wherein the protective member covers a nozzle surface on which the nozzle rows are formed and has openings arranged along the nozzle rows.

6. The fluid ejecting head according to claim 1, further comprising:

a temperature detector which detects a temperature of the fluid; and a controller which controls drive of the heating unit on the basis of a result detected by the temperature detector.

7. The fluid ejecting head according to claim 6, wherein the temperature detector detects the temperature of the fluid on the basis of a temperature of the protective member.

8. The fluid ejecting head according to claim 1, wherein a heat generating section of the heating unit is interposed between a case member supporting the nozzle plate and the protective member, and wherein the fluid ejecting head further comprises a sealing member which seals the heat generating section by allowing a space between the case member and the protective member to be liquid-tight.

9. The fluid ejecting head according to claim 1, wherein the heat generating section of the heating unit is interposed between a case member supporting the nozzle plate and the protective member, and wherein the fluid ejecting head further comprises a locking member which comes in contact with the protective member to lock opening of the protective member in a direction that is away from the case member.

10. The fluid ejecting head according to claim 9, wherein the locking member also functions as a heat insulating member which covers the protective member and restrains heat dissipation to the ambient air.

11. A fluid ejecting apparatus which ejects a fluid onto a predetermined target from a fluid ejecting head, the fluid ejecting apparatus comprising the fluid ejecting head according to claim 1 as the fluid ejecting head.

* * * * *